US006547532B2

(12) United States Patent
Gonzalez et al.

(10) Patent No.: US 6,547,532 B2
(45) Date of Patent: Apr. 15, 2003

(54) ANNULAR SUCTION VALVE

(75) Inventors: Jose Rafael Gonzalez, Los Teques Miranda (VE); Marice V Urbina, Edo Vargas (VE); Luis R Casique, Caracas (VE)

(73) Assignee: Intevep, S.A., Caracas (VE)

( * ) Notice: Subject to any disclaimer, the term of this patent is extended or adjusted under 35 U.S.C. 154(b) by 0 days.

(21) Appl. No.: 09/872,673

(22) Filed: Jun. 1, 2001

(65) Prior Publication Data

US 2002/0182084 A1 Dec. 5, 2002

(51) Int. Cl.[7] ..... F04F 5/00
(52) U.S. Cl. ..... 417/197; 417/198; 166/372
(58) Field of Search ..... 417/197, 198, 417/108, 182.5; 166/372, 373, 369, 105, 380, 68

(56) References Cited

U.S. PATENT DOCUMENTS 857,768 A * 6/1907 Stirling ..... 417/197
2,444,615 A * 7/1948 Reinhardt ..... 103/267
4,322,897 A * 4/1982 Brassfield ..... 37/62
4,444,253 A * 4/1984 Smith et al. ..... 166/191
5,074,759 A * 12/1991 Cossairt ..... 417/198
5,562,161 A 10/1996 Hisaw et al.
5,707,214 A * 1/1998 Schmidt ..... 417/109
5,785,124 A 7/1998 Hisaw et al.
5,806,599 A * 9/1998 Hisaw et al. ..... 166/372
5,992,521 A * 11/1999 Bergren et al. ..... 166/265
6,042,341 A * 3/2000 Richter ..... 417/151

* cited by examiner

*Primary Examiner*—Charles G. Freay
*Assistant Examiner*—Han L. Liu
(74) *Attorney, Agent, or Firm*—Bachman & LaPointe, P.C.

(57) ABSTRACT

An annular suction valve includes a substantially tubular member having an inner surface defining a valve flow passage having an inlet, a nozzle disposed in the inlet and spaced from the inner surface so as to define an annular passage between the inner surface and the nozzle, the nozzle further defining an interior flow passage and having a nozzle inlet to the interior flow passage; and a power fluid inlet in one of the nozzle and the tubular member for receiving power fluid into the annular passage.

9 Claims, 3 Drawing Sheets

ANNULAR SUCTION VALVE

BACKGROUND OF THE INVENTION

The invention relates to the field of fluid flow and, more particularly, to a suction annular valve which is useful in production wells and pipelines, for example for production and conveyance of hydrocarbons.

In the hydrocarbon production field, it is common to use fluid lift to enhance production of hydrocarbons from subterranean formations through production tubes or wells.

Various methods for enhancing such production include gas lift, steam injection, solvent injection, and numerous other well known techniques.

U.S. Pat. No. 5,806,599 is drawn to a method for accelerating production using a jet pump having a central nozzle which is believed to assist in production. Such a device, however, positions the nozzle in an obstructive position in the production tube, and causes high pressure losses. Further, because the nozzle is centrally located, it also interferes with the normal use of other conventional devices such as wire line calibrators and the like.

Further, conventional equipment such as disclosed in the aforesaid patent is particularly susceptible to corrosive or erosive conditions within the well, for example such as sand in the production stream and the like.

It is clear that the need remains for improved devices and methods for producing fluid from subterranean formations through production wells. The need further remains for improvements in fluid flow through surface pipelines.

It is therefore the primary object of the present invention to provide flow equipment which enhances flow without blocking or obstructing the flow passage.

It is a further object of the present invention to provide an apparatus whereby fluid flow rates can be enhanced through production tubes and pipelines as well.

It is still another object of the present invention to provide an apparatus which can be used without interfering with the use of other conventional equipment.

Another object of the present invention is to provide an apparatus which is not particularly susceptible to various corrosive or erosive mechanisms within the production tube, such as sand.

Other objects and advantages of the present invention will appear hereinbelow.

SUMMARY OF THE INVENTION

In accordance with the present invention, the foregoing objects and advantages have been readily attained.

According to the invention, an annular suction valve is provided, which valve comprises a substantially tubular member having an inner surface defining a valve flow passage having an inlet; a nozzle disposed in said inlet and spaced from said inner surface so as to define an annular passage between said inner surface and said nozzle, said nozzle further defining an interior flow passage and having a nozzle inlet to said interior flow passage; and a power fluid inlet in one of said nozzle and said tubular member for receiving power fluid into said annular passage.

A fluid production system is also provided in accordance with the present invention, wherein the system comprises a production tube communicated with a fluid to be produced; a source of power fluid; and an annular suction valve comprising a substantially tubular member defining a valve flow passage having an inlet, a nozzle disposed in said inlet and spaced from said inner wall surface so as to define an annular passage between said inner surface and said nozzle, said nozzle further defining an interior flow passage and having a nozzle inlet to said interior flow passage, and a power fluid inlet in one of said nozzle and said tubular member for receiving power fluid from said source of power fluid into said annular passage.

In further accordance with the invention, a method for enhancing flow of a fluid through a conveyance member is also provided, which method comprises the steps of providing a fluid conveyance member having a fluid conveyance passage; providing an annular suction valve comprising a substantially tubular member having an inner surface defining a valve flow passage having an inlet, a nozzle disposed in the inlet and spaced from the inner surface so as to define an annular passage between said inner surface and said nozzle, said nozzle further defining an interior flow passage and having a nozzle inlet to said interior flow passage, and a power fluid inlet in one of said nozzle and said tubular member for receiving power fluid into said annular passage, said annular suction valve being disposed along said production tube with said nozzle inlet communicated with said fluid to be produced and said power fluid inlet communicated with said source of power fluid.

The annular suction valve in accordance with the present invention advantageously enhances flow by creating suction downstream of a nozzle communicated with the fluid to be produced. Further, the annular nature of the valve reduces or eliminates obstruction to flow which normally occurs with conventional devices.

Still further, the annular structure of the device of the present invention helps to reduce or eliminate the erosion which may be experienced due to sand in the production stream.

The annular suction valve of the present invention further leaves the central portion of the production tube open such that conventional equipment can be disposed therethrough.

BRIEF DESCRIPTION OF THE DRAWINGS

A detailed description of preferred embodiments of the present invention follows, with reference to the attached drawings, wherein.

DETAILED DESCRIPTION

The invention relates to enhancement of flow of fluid, for example enhancement of flow of hydrocarbons through production tubes in hydrocarbon producing oil wells, and conveyance or transportation of such hydrocarbons through surface pipelines and the like.

Figure 1:
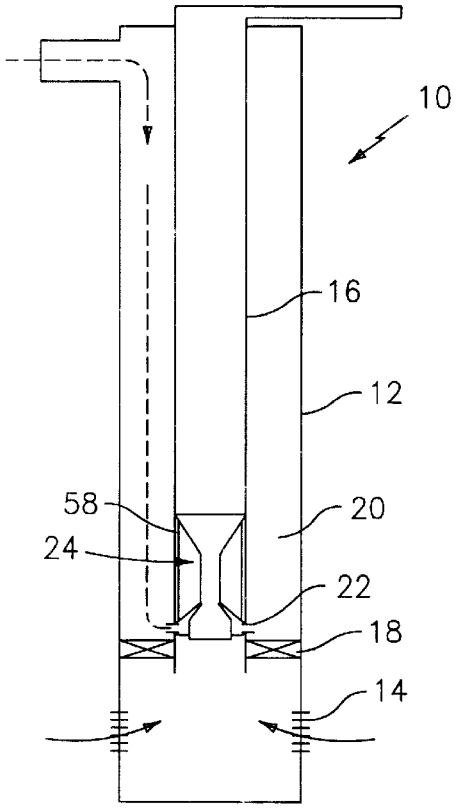
FIG. 1 schematically illustrates an annular suction valve in accordance with the present invention in an environment of use.

FIG. 1 shows a typical production well 10 having a casing 12 with perforations 14 for allowing reservoir fluids such as crude hydrocarbons and the like to enter the casing as illustrated. Production well 10 also includes a production tube 16 which is typically set within casing 12 with a packer 18 disposed therebetween such that fluids produced from the formation, through perforations 14, flow upwardly through production tube 16.

An annular space 20 is defined between casing 12 and production tube 16, and gas can be injected into annular space 20 to assist in production of fluids through production tube 16. This gas flows into production tube 16 through one or more passages or inlets 22.

In accordance with the present invention, an annular suction valve 24 is advantageously provided along production tube 16 to govern flow of gas or other power fluid so as to enhance production of hydrocarbons through production tube 16 as desired.

Figure 3:
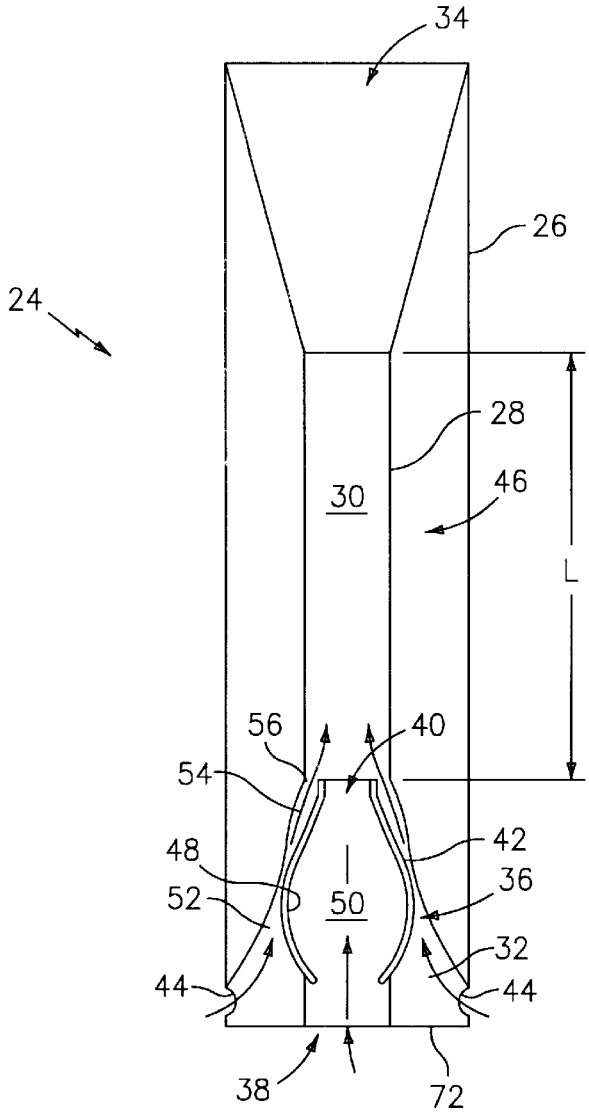
FIG. 3 is an enlarged schematic view of an annular suction valve in accordance with the present invention.

Turning to FIG. 3, annular suction valve 24 in accordance with the present invention is further illustrated. In accordance with the invention, annular suction valve 24 preferably includes a substantially tubular member 26 having an inner surface 28 which defines a flow passage 30 having an inlet 32 and an outlet 34. A nozzle 36 is advantageously disposed in inlet 32 and has a nozzle inlet 38 and a nozzle outlet 40. Nozzle 36 is preferably positioned within inlet 32 so as to define a substantially annular flow passage 42 therebetween, and an inlet 44 is provided for communicating annular flow passage 42 with a point exterior to annular suction valve 24, for example from annular space 20 (FIG. 1).

As shown, inner surface 28 of tubular member 26 may advantageously be provided having a convergent profile at inlet 32, and a divergent profile at outlet 34.

As used herein, a convergent profiled flow passage is one wherein the walls defining the passage converge in a direction of flow, such that cross sectional area for flow defined by the surface decreases in the direction of flow. Also as used herein, a divergent profiled flow passage is one wherein the walls defining the flow passage diverge in a direction of flow, such that the cross sectional area for flow defined by the surface increases in the direction of flow.

In accordance with the present invention, tubular member 26 may also be advantageously be provided having inner surface 28 defining a substantially straight section 46 between convergent inlet 32 and divergent outlet 34 as shown.

Nozzle 36 may advantageously be provided having a wall member 48 which defines an interior flow passage 50 between inlet 38 and outlet 40, and wall member 48 is advantageously contoured so as to provide annular flow passage 42 with a convergent annular flow passage 52 followed by a divergent annular flow passage 54 and a substantially annular outlet 56 communicating annular flow passage 42 with flow passage 30.

In use, annular suction valve 24 is positioned along a production tube 16 with nozzle inlet 38 communicated with fluids to be produced, and with inlet 44 communicated with a source of pressurized power fluid. Power fluid is introduced into inlet 44 as shown, and flows through annular flow passage 42 and out of annular outlet 56 into flow passage 30. As such fluid expands into the volume of flow passage 30, a low pressure zone is created in flow passage 30 which draws fluid into inlet 38, through nozzle 36 and also into flow passage 30 for production as desired.

The structure of annular outlet 56 further serves to define a substantially annular flow of power fluid along wall surfaces of flow passage 30, thereby further enhancing flow through annular suction valve 24 by removing drag due to contact of the fluid produced, which may be viscous or heavy hydrocarbons, with the wall surfaces of suction valve 24.

Divergent outlet 34 advantageously serves to encourage mixing of power fluid with hydrocarbon fluids being produced, to further assist in transport through the production tube or pipeline.

Returning to FIG. 1, in this configuration, power fluid is conveyed through an opening or passage 22, and flow through passage 22 is typically controlled by a sliding sleeve 58 which can be vertically moved within production tube 16 so as to cover or uncover passages 22 and thereby allow or prevent flow of gas or other power fluid into production tube 16.

In this embodiment of the present invention, annular suction valve 24 is advantageously mounted on sliding sleeve 58 such that inlet 44 to annular flow passage 42 is aligned with or communicated with passages 22 when desired.

It should be appreciated that annular suction valve 24 in accordance with the present invention provides for substantial improvement in flow of fluids through same, while avoiding structures positioned in the central portion of production tube 16 which interfere with other conventional devices, and further which tend to cause inefficient flow patterns around same.

Figure 2:
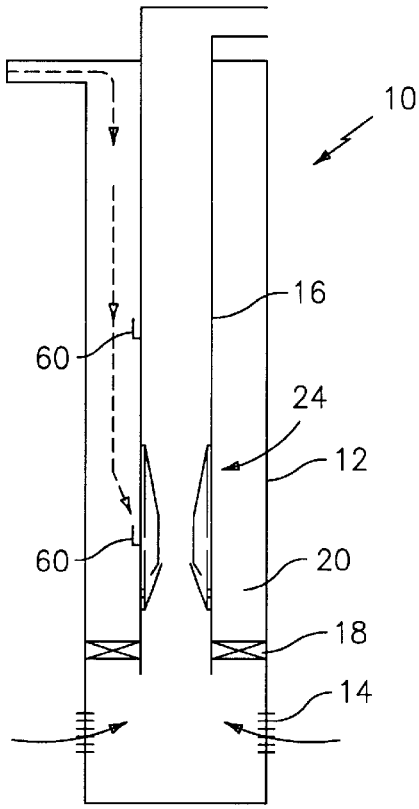
FIG. 2 illustrates use of an annular suction valve according to the invention in a different configuration.

FIG. 2 shows an alternate environment of use of the present invention, wherein mandrels 60 are provided along production tube 16 and can be selectively operated to inject gas or other power fluid into production tube 16 at one or more points as desired. In this environment of use, annular suction valve 24 is advantageously secured to a section of tubing which is used to isolate and communicate with a gas lift mandrel 60 so as to allow power fluid introduced through annular space 20 to flow into annular suction valve 24 as desired in accordance with the present invention.

Figure 4:
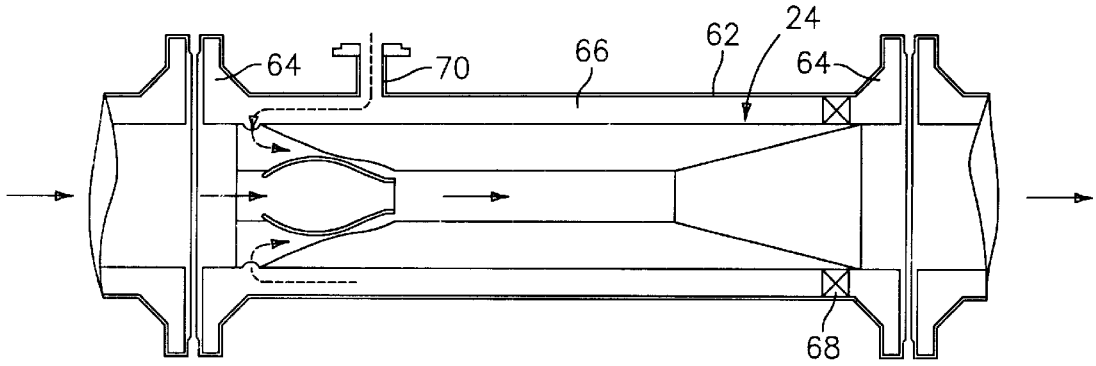
FIG. 4 illustrates an annular suction valve in accordance with the present invention in a further environment of use.

FIG. 4 shows another environment of use of an annular suction valve 24 in accordance with the present invention, wherein annular suction valve 24 is mounted within a section of tubing 62 having mounting flanges 64 at each end for use in mounting along a pipeline or tubing as desired.

In this embodiment, annular suction valve 24 is disposed within tubing section 62 so as to define an annular space 66 therebetween, with a packer 68 or other type of seal also disposed therebetween so as to force gas or other power fluid introduced through gas inlet 70 to flow into annular suction valve 24 as desired.

Figure 5:
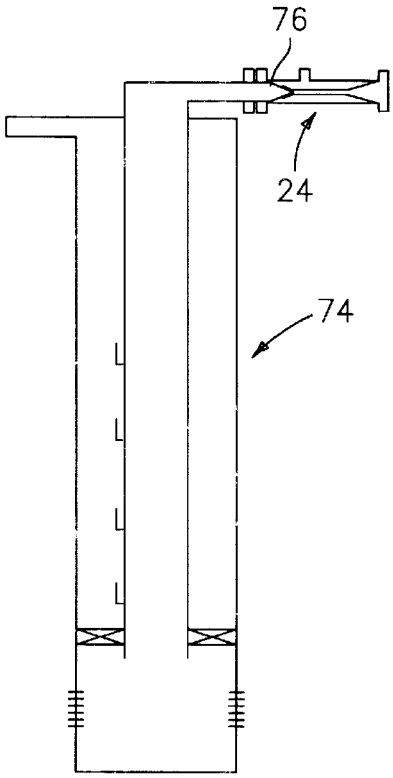
FIGS. 5–7 illustrate positioning of annular suction valves in accordance with the present invention in particularly advantageous locations.
Figure 7:
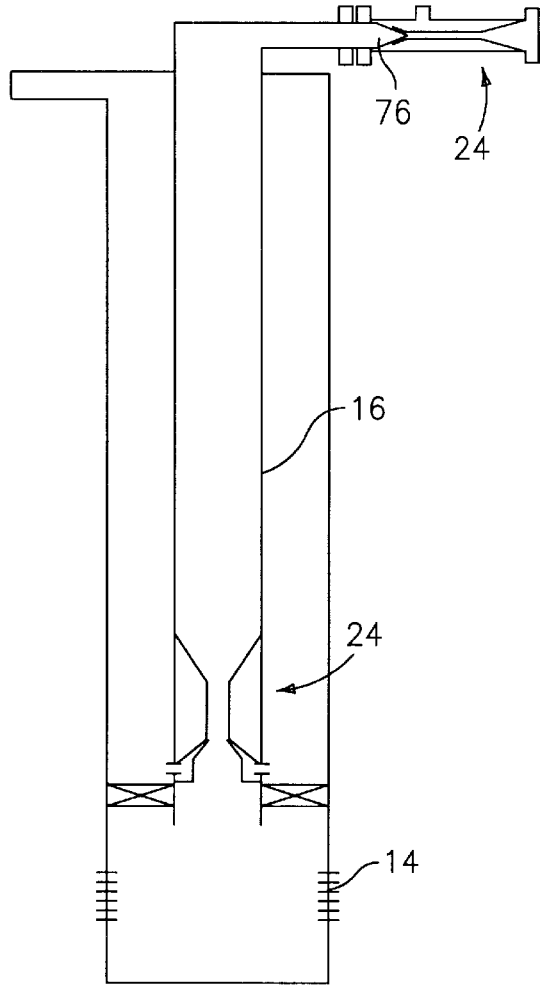
Figure 6:
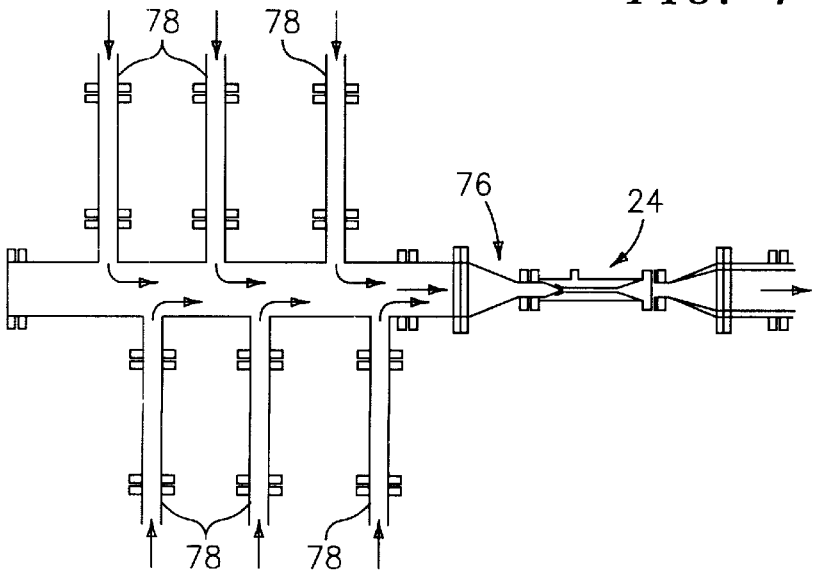

FIGS. 5, 6 and 7 illustrate various configurations using annular suction valve 24 in accordance with the present invention to enhance production.

FIG. 5 shows a conventional gas lift well 74 with a surface pipeline 76 having an annular suction valve 24 in accordance with the present invention disposed therein. In this configuration, fluids would be produced from the subterranean formation with the assistance of conventional gas lift, and flow would be enhanced through the surface pipeline using annular suction valve 24 in accordance with the present invention.

FIG. 6 shows a similar configuration wherein an annular suction valve 24 is positioned along a pipeline 76 collecting flow from six different sources 78. In these embodiments, annular suction valve 24 is disposed along the surface pipeline mounted within a tubing section such as tubing section 62 (FIG. 4), and advantageously serves to increase flow of fluid due to suction created by injection of power fluid as described above.

FIG. 7 shows a further preferred embodiment wherein an annular suction valve 24 is disposed downhole to facilitate flow of fluids from the reservoir, through perforations 14 and into production tube 16, and another annular suction valve 24 is positioned along a surface pipeline 76 to further assist in conveying fluid along same.

As set forth above, it should be readily appreciated that the structure of annular suction valve is both simple and desirable for use in accordance with the present invention. Particularly, the annular nature of annular suction valve 24 allows use of other conventional equipment in the production tube, particularly conventional equipment which must be passed through the center of production tube 16. This is not the case with conventional flow enhancing devices that define a nozzle down the center of the production tube.

Further, the structure of annular suction valve 24 in accordance with the present invention avoids positioning of erosion-susceptible surfaces where sand and the like entrained in fluid flowing through annular suction valve 24 could be detrimental to same.

Annular suction valve 24 may be used in any tubular flow application when power fluid is to be used to enhance flow of another fluid, for example, in the production of hydrocarbons through production tubes to the surface and/or the transportation of hydrocarbons through surface pipelines and the like. In this environment of use, typical power fluid could be gas, steam, solvent, gas-oil, water, diluent, light oil and combinations thereof.

Returning to FIG. 3, annular suction valve 24 in accordance with this embodiment is provided as a two-piece assembly. Tubular member 26 can advantageously be provided having inner surface 28 defined therein as described, while nozzle 36 may be provided as a separate member, for example having a flange 72 extending from an inlet end thereof and adapted to engage tubular member 26 and properly position nozzle 36 relative to tubular member 26.

It should also be appreciated that the specific dimensions of flow passage 30 in accordance with the present invention are also to be determined based upon the specifics of a fluid to be produced. In this regard, particular variables of interest would be the length L of substantially straight section 46, the length and slope of convergent and divergent surfaces, and the contours of nozzle 36. Further, it may be preferable to provide inlet 32 of inner surface 28 having a wavy inner surface as illustrated so as to further enhance the flow of power fluid through annular passage 42 and into flow passage 30 as desired.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An annular suction valve, comprising:

a substantially tubular member having an inner surface defining a valve flow passage having an inlet;

a nozzle disposed in said inlet and spaced from said inner surface so as to define an annular passage between said inner surface and said nozzle, said nozzle further defining an interior flow passage and having a nozzle inlet to said interior flow passage wherein said inner surface at said inlet and an outer surface of said nozzle are adapted to define said annular passage having a converging cross sectional flow area followed by a diverging cross sectional flow area; and a power fluid inlet in one of said nozzle and said tubular member for receiving power fluid into said annular passage.

2. The valve according to claim 1, wherein said nozzle has an outlet communicating said interior flow passage with said valve flow passage, and wherein said annular passage is communicated with said valve flow passage.

3. The valve according to claim 1, wherein said inner surface defines said valve flow passage having a convergent contour at said inlet.

4. The valve according to claim 3, wherein said inner surface further defines an outlet having a divergent contour.

5. A fluid production system, comprising:

a production tube communicated with a fluid to be produced said production tube is a tubing section having flange ends adapted to be communicated along said production tube, wherein an inner surface of said tubing section and an outer surface of an annular suction valve define an outer annular space communicated with a source of power fluid and with a power fluid inlet; and the annular suction valve comprising a substantially tubular member having an inner surface defining a valve flow passage having an inlet, a nozzle disposed in said inlet and spaced from said inner surface so as to define an annular passage between said inner surface and said nozzle, said nozzle further defining an interior flow passage and having a nozzle inlet to said interior flow passage, and a power fluid inlet in one of said nozzle and said tubular member for receiving power fluid into said annular passage, said annular suction valve being disposed along said production tube with said nozzle inlet communicated with said fluid to be produced and said power fluid inlet communicated with said source of power fluid.

6. The system according to claim 5, wherein said annular suction valve is mounted inside a sliding sleeve disposed in said production tube.

7. The system according to claim 5, wherein an inner surface of said tubing section and an outer surface of said annular suction valve define an outer annular space communicated with said source of power fluid and with said power fluid inlet.

8. An annular suction valve, comprising:

a substantially tubular member having an inner surface defining a valve flow passage having an inlet;

a nozzle disposed in said inlet and spaced from said inner surface so as to define an annular passage between said inner surface and said nozzle, said nozzle further defining an interior flow passage and having a nozzle inlet to said interior flow passage wherein said inner surface defines said valve flow passage having a convergent contour at said inlet and said inner surface further defines an outlet having a divergent contour; and a power fluid inlet in one of said nozzle and said tubular member for receiving power fluid into said annular passage.

9. The valve according to claim 8, wherein said inner surface at said inlet and an outer surface of said nozzle are adapted to define said annular passage having a converging cross sectional flow area followed by a diverging cross sectional flow area.

* * * * *